US005630533A

United States Patent [19]

Cortese

[11] Patent Number: 5,630,533

[45] Date of Patent: May 20, 1997

[54] METHOD AND DEVICE FOR FOLDING WOMEN'S TIGHTS ON HOSE SHAPING MACHINES

[76] Inventor: Carmelo A. Cortese, Via Porrettana, 134/4, 40037 Sasso Marconi, Italy

[21] Appl. No.: 589,291

[22] Filed: Jan. 22, 1996

[30] Foreign Application Priority Data

Jan. 27, 1995 [IT] Italy ..... BO95A0023

[51] Int. Cl.[6] ..... D06C 5/00

[52] U.S. Cl. ..... 223/77; 223/75; 223/37; 223/38

[58] Field of Search ..... 223/75, 76, 77, 223/37, 38

[56] References Cited

U.S. PATENT DOCUMENTS

| | | | |
|---|---|---|---|
| 2,032,310 | 2/1936 | Reinert | 223/75 |
| 2,080,324 | 5/1937 | Logan | 223/75 |
| 2,509,532 | 5/1950 | Salevsky et al. | 223/75 |
| 4,434,918 | 3/1984 | Hodges | 223/75 |
| 4,703,877 | 11/1987 | Kuniki et al. | 223/76 |
| 5,094,371 | 3/1992 | Takamura et al. | 223/75 |

FOREIGN PATENT DOCUMENTS

| | | | |
|---|---|---|---|
| 236123 | 5/1986 | Germany | 223/75 |
| 2236545 | 4/1991 | United Kingdom . | |

*Primary Examiner*—Bibhu Mohanty

*Attorney, Agent, or Firm*—Shlesinger, Arkwright & Garvey

[57] ABSTRACT

A method of folding women's tights on a hose shaping machine, whereby the tights are fitted onto respective pairs of tubular forms fitted to a carousel conveyor and set to a parted position in which the forms substantially lie in the same vertical plane; at least one of the forms is rotated to bring the forms together into a facing position in parallel planes; in time with the rotation of the forms into the facing position, a first tensioning member operates on the front of the body of the tights, in an intermediate plane between the forms, to slide the body in relation to the forms and form a center fold in the body; and a second tensioning member operates on the rear of the body, in the intermediate plane between the forms, to form an opposite center fold in the body.

10 Claims, 4 Drawing Sheets

Fig. 4
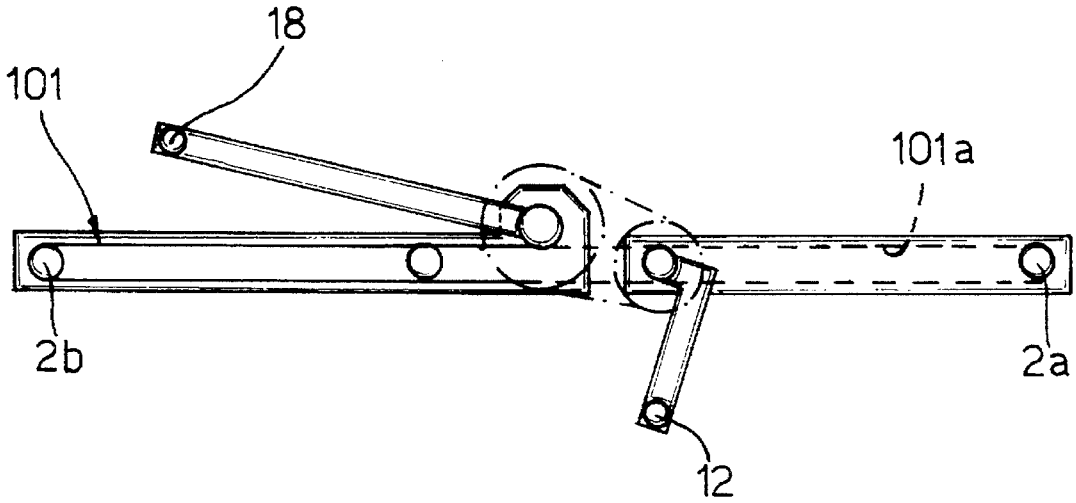
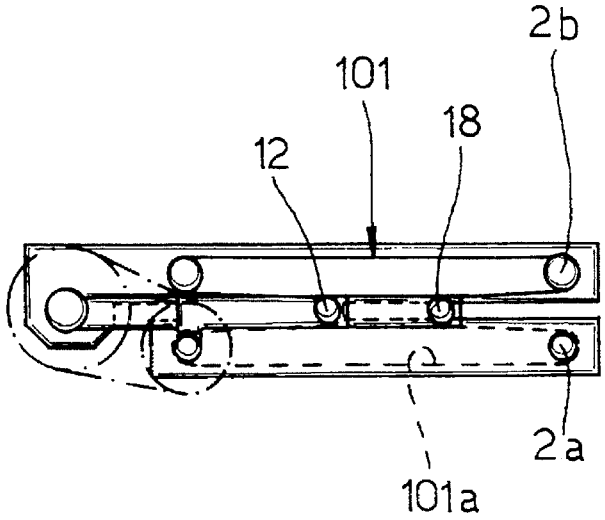
Fig. 5

METHOD AND DEVICE FOR FOLDING WOMEN'S TIGHTS ON HOSE SHAPING MACHINES

BACKGROUND OF THE INVENTION

The present invention relates to a method and device for folding women's tights on hose shaping machines.

As is known, in the hosiery industry, tights are heat treated prior to packing. In particular, they are normally subjected to a shaping process by stretching them over forms and heat treating them, e.g. in pressurized steam chambers, to set them permanently to the desired shape.

At present, known machines for shaping tights comprise a carousel conveyor fitted with forms onto which the tights are stretched and on which the tights are fed by the conveyor into a shaping chamber, e.g. a steam chamber, and subsequently into a drying chamber from which they are extracted for further processing.

The steam chamber of traditional machines is normally large enough to accommodate a number of forms at the same time, and the machines themselves present a large number of forms and are fairly bulky, mainly due to the size of the steam chamber. Which latter characteristic results in the consumption of a large amount of steam, and consequently in high running costs and damp working conditions.

Patent Application n. BO93A 000484, filed by the present Applicant, relates to a hose shaping machine featuring a carousel conveyor with a number of pairs of peripheral tubular forms, which are supplied with compressed air that comes out through holes at the top of the forms to blow the corresponding end of the tights towards withdrawal means at a removal station. The conveyor is fed in steps through a station where the tights are fitted onto the tubular forms, through at least one station where the tights are shaped inside a steam chamber for accommodating a pair of forms, and through the removal station where the tights are removed from the forms.

The above machine eliminates the former drawback whereby tights were treated on solid forms reproducing the finished shape, and the tubular forms enable the use of a compact steam chamber for treating one pair of forms at a time.

As shown by way of example in FIG. 6, the above patent application relates to the formation of tights folded trouser-fashion, whereby the legs 100 are stretched in planes perpendicular to that defined by the sides of body 101.

In the above solution, fitting the tights onto the forms is fairly difficult and involves a certain amount of force, which, besides making more work for operator, may damage the tights, particularly, as is normally the case, when working with very fine yarn.

To simplify fitment and removal of the tights, some shaping machines feature collapsible forms comprising, for example, a pair of hinged metal elements which are brought together and parted by means of appropriate mechanisms. Such forms, however, are obviously complex and expensive, and fail to provide for troublefree fitment and removal, due to the sharp projection defined by the foot and heel of the tights.

SUMMARY OF THE INVENTION

It is an object of the present invention to overcome the above drawback by providing a method of effectively folding tights trouser-fashion on a hose shaping machine.

It is a further object of the present invention to provide a straightforward, reliable, versatile device implementing the above method.

According to the present invention, there is provided a method of folding tights on a hose shaping machine comprising a carousel conveyor with a number of pairs of peripheral tubular forms for receiving respective tights; characterized in that it comprises the steps of fitting the tights onto respective forms set to a parted position wherein the forms substantially lie in the same vertical plane; rotating at least one of said forms so that the forms are brought together into a facing position in parallel planes; operating on the front of the body of the tights, in an intermediate plane between the forms, by means of a first tensioning member operating in time with said rotation of the forms into the facing position, to cause said body to slide in relation to the forms and to form a center fold in the body; and operating on the rear of the body, in said intermediate plane between the forms, by means of a second tensioning member to form an opposite center fold in the body.

BRIEF DESCRIPTION OF THE DRAWINGS

A preferred, non-limiting embodiment of the device according to the present invention will be described by way of example with reference to the accompanying drawings, in which:

FIGS. 4 and 5 show a plan view of the tights fitted to the forms in the parted and facing position respectively;

DETAILED DESCRIPTION OF THE INVENTION

Figure 1:
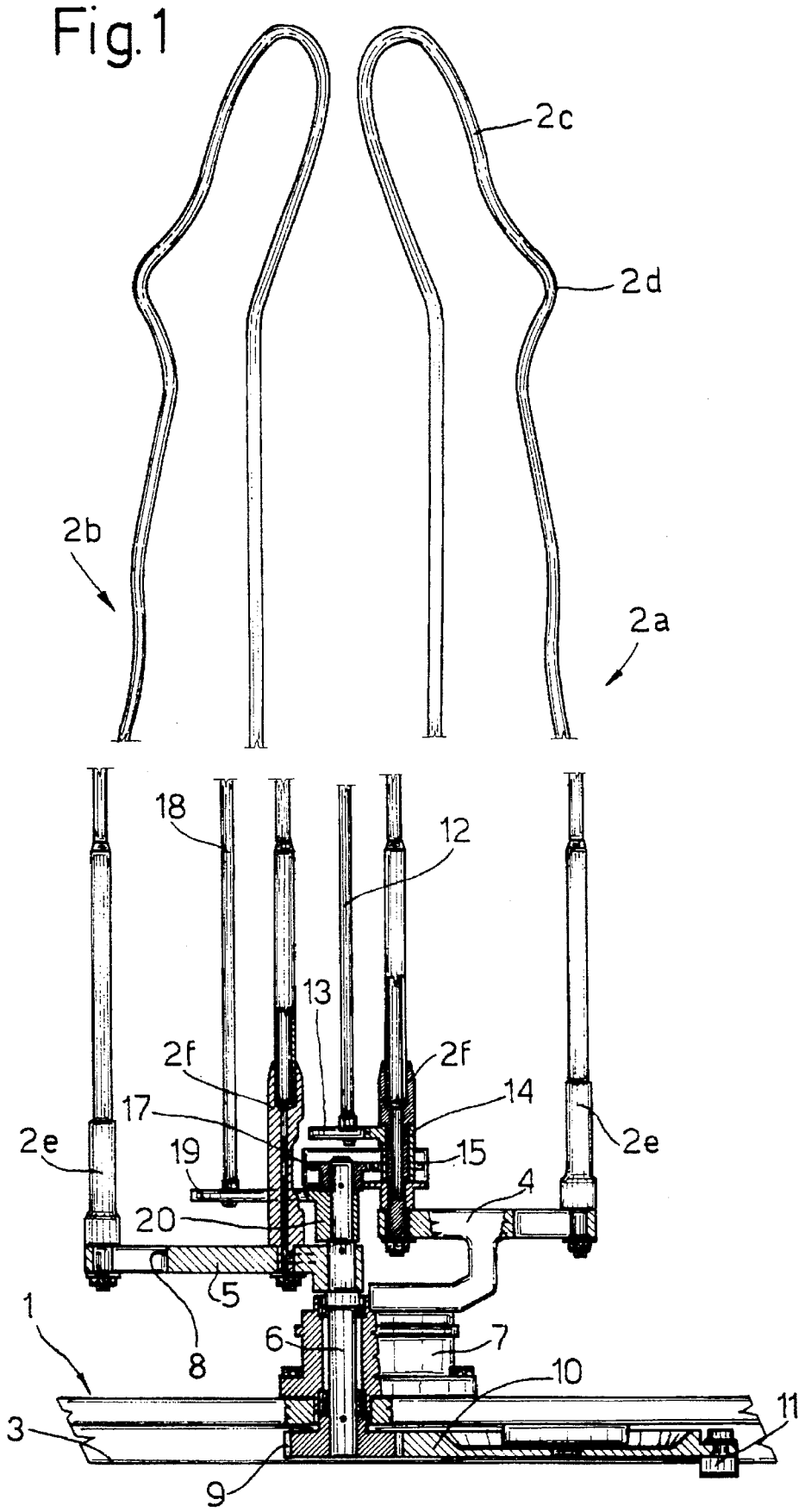
FIG. 1 shows a partly sectioned front view of a pair of tubular forms on a machine for shaping tights.

Number 1 in the accompanying drawings indicates the platform of a circular carousel conveyor featuring a number of pairs of peripheral tubular forms 2*a*, 2*b* for receiving respective pairs of tights. Platform 1 is fitted to a base 3 so as to rotate about a vertical axis, and is fed in steps, in known manner, through a number of operating stations for manipulating and heat treating the tights.

Forms 2*a*, 2*b* comprise respective tubular elements bent at the top into the shape of a foot 2*c* presenting a heel 2*d*. In particular, foot 2*c* is inclined at an angle of no more than 25° and preferably of 10° to 25° in relation to the longitudinal axis of the form.

The tubular elements are also preferably made of portions of upwardly decreasing thickness.

Forms 2*a*, 2*b* may be parted so that they lie in the same vertical plane, to assist fitment of the tights, and may be brought together into parallel planes to shape and withdraw the tights at the respective operating stations.

For this purpose, the bottom portions 2*e*, 2*f* of the tubular elements are fitted at the bottom to respective supports 4, 5 of forms 2*a*, 2*b*; support 5 of second form 2*b* is connected to a pin 6 fitted for rotation, about a vertical axis, through the body of a coupling 7 integral with conveyor 1; and support 4 of first form 2*a* is connected rigidly to coupling 7 in a vertical plane substantially tangential to conveyor 1.

Forms 2*a*, 2*b* are symmetrical with each other in the parted position, so that the profiles match when brought together into the facing position. In particular, the feet 2*c* of forms 2a, 2b converge in the parted position to simplify fitment of the tights.

To further simplify fitment of the tights, the elasticity of the tubular elements may be exploited to make forms 2a, 2b collapsible at the base, for example, by sliding the respective outer bottom tubular elements 2e of the parted forms 2a, 2b transversely inside slots 8 formed in respective supports 4, 5.

As described in detail in Patent Application n. BO93A 000484, forms 2a, 2b are supplied with compressed air, which comes out through a number of holes at the top of the forms to blow the corresponding ends of the tights towards withdrawal means at a removal station.

Pin 6 is fitted on the bottom end with a gear 9 meshing with a sector gear 10 pivoting beneath platform 1 of the conveyor; and sector gear 10 presents a roller 11 rolling freely about a vertical axis and engaging a fixed cam formed in base 3 of the machine.

Figure 2:
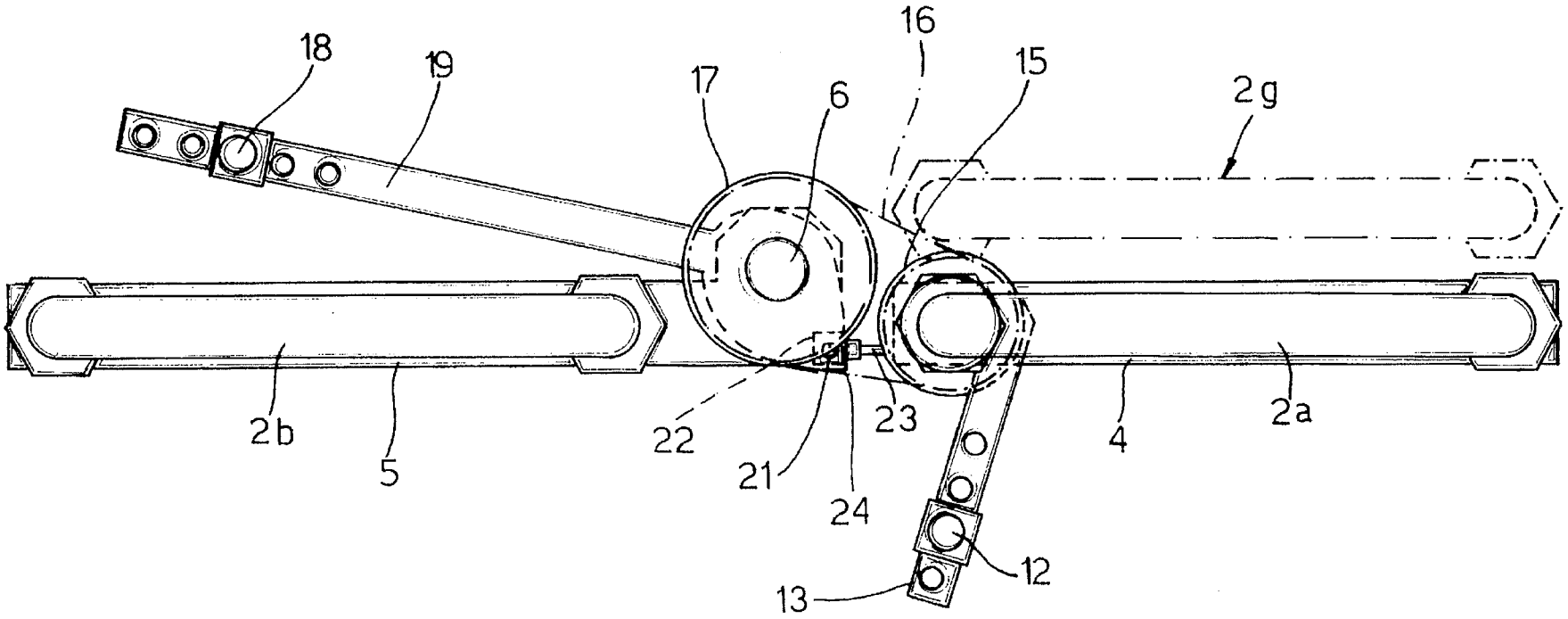
FIG. 2 shows a schematic top plan view of the FIG. 1 forms.

The rotation of gear 9 by sector gear 10 produces a corresponding rotation of movable form 2b between said parted position and said facing position of forms 2a, 2b, in which facing position, movable form 2b is set as shown by the dotted line 2g in FIG. 2.

Fixed form 2a presents a vertical first tensioning member 12 operating in an intermediate plane between forms 2a, 2b, and on the front of tights 100, i.e. on seam 102 of body 101.

Tensioning member 12 comprises a rod fitted adjustably at the base to an arm 13 extending horizontally from a sleeve 14 rotating on the inner bottom portion 2f of fixed form 2a. Sleeve 14 forms a sprocket 15, which, by means of a flexible transmission member, e.g. a chain, is connected to a further sprocket 17 in turn fitted to the top of pin 6.

Movable form 2b in turn presents a vertical second tensioning member 18 operating in an intermediate plane between forms 2a, 2b and on the rear of body 101 of tights 100.

Tensioning member comprises a rod fitted adjustably at the base to an arm 19 extending horizontally from a sleeve 20 rotating freely on pin 6 of movable form 2b.

At the bottom, tensioning member 18 presents an integral tooth 21 extending from sleeve 20 of member 18, and which, as forms 2a, 2b move back into the parted position, engages a corresponding seat 22 formed in movable form 2b.

The return travel of tensioning member 18 is defined by an adjustable screw 23 fitted to support 4 of fixed form 2a, and which acts as a stop for a shaped tip 24 on member 18.

Figure 3:
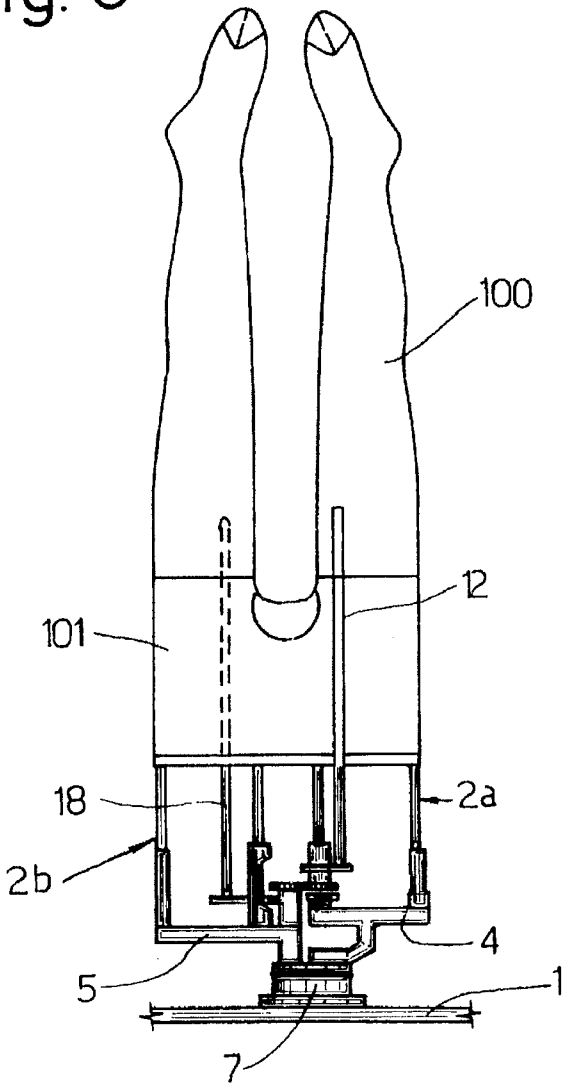
FIG. 3 shows a front view of a pair of tights fitted to the FIG. 1 forms.

At the start of each operating cycle, the method according to the present invention comprises fitting a pair of tights 100 onto tubular forms 2a, 2b arrested at the input station of the machine (FIG. 3).

That is, the operator provides for easing tights 100 onto the top portion of forms 2a, 2b commencing with body 101. Complete fitment of the tights onto the forms may of course be assisted by appropriate gripping means operating in time with the manual operation, as described in detail in Patent Application n. BO93A 000484.

Tights 100 are fitted onto forms 2a, 2b in the parted position to simplify fitment, which is further simplified, especially as regards fitting the tights over the projection defined by heel 2d of foot 2c, by the very small angle of foot 2c in relation to the longitudinal axis of forms 2a, 2b.

When forms 2a, 2b are rotated into the facing position, the legs of tights 100 are accordingly paired, and a center fold coinciding with seam 102 is formed in body 101.

Forms 2a, 2b are set to the facing position in particular by rotating pin 6 to rotate movable form 2b into the position shown by the dotted line 2g in FIG. 2.

By means of the gear formed by sprockets 15 and 7, the rotation of pin 6 also rotates arm 13 fitted with first tensioning member 12, which therefore acts on the front of body 101 of tights 100, in an intermediate plane between forms 2a, 2b, and in time with rotation of the forms into the facing position.

The action of tensioning member 12 causes body 101 to slide in relation to forms 2a, 2b, and results in the formation of a center fold in body 101.

For the sake of clarity, number 101a in FIGS. 4 and 5 indicates the same portion of body 101, to illustrate the manner in which it slides from the initial position in which forms 2a, 2b are parted, to the final position in which the forms are set facing each other.

In the facing position, tensioning member 12 is inserted between forms 2a, 2b to define the center fold in body 101.

At the same time, rotation of movable form 2b causes the second tensioning member 18 to operate on the rear of body 101, in the intermediate plane between forms 2a, 2b, and in time with first tensioning member 12, to form a center fold in body 101, opposite the front center fold formed by first tensioning member 12 (FIG. 5).

Figure 6:
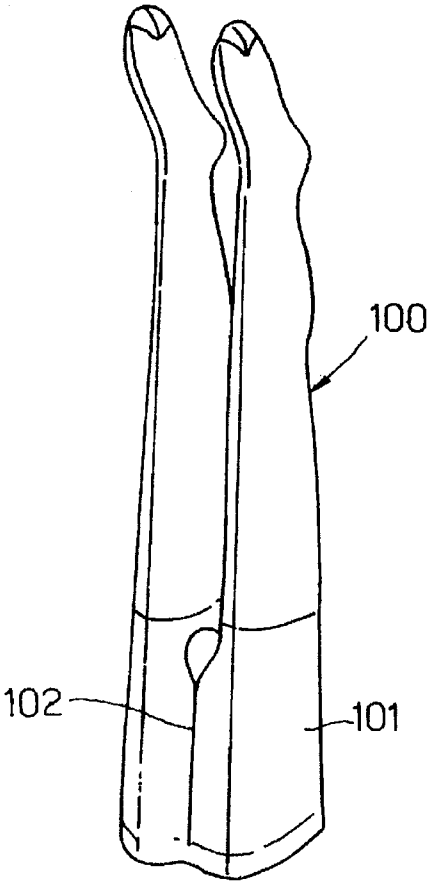
FIG. 6 shows a view in perspective of the tights folded trouser-fashion.

As a result, tights 100 are folded trouser-fashion (FIG. 6) in the configuration in which they are eventually removed from the machine.

Tights 100, fitted to forms 2a, 2b in the above configuration, are then fed by conveyor 1 in known manner into a shaping chamber, e.g. a pressurized steam chamber, and from there to the removal station.

Following removal of tights 100, forms 2a, 2b are restored to the parted position by inversely rotating movable form 2b, which restores tensioning members 12 and 18 to the initial position clear of forms 2a, 2b to permit fitment of tights 100.

First tensioning member 12 in fact is controlled positively by the rotation of pin 6 of movable form 2b via the gear formed by sprockets 15, 17, whereas second tensioning member 18 is drawn, during the return stroke, by tooth 21 of movable form 2b engaging seat 22. The return stroke is defined by the fixed stop defined by screw 23, so that, at the end of its travel, arm 19 of tensioning member 18 is inclined in relation to form 2b as shown in FIG. 2.

The method and device according to the present invention therefore provide for effectively forming tights folded trouser-fashion, i.e. with the legs stretched in planes perpendicular to that defined by the sides of the body.

As stated, this is achieved by sliding the body in relation to the forms to which the tights are fitted for shaping, i.e. in relation to the paired legs which are fixed in relation to the forms.

An important point to note is that the above result is achieved using a device which provides for troublefree fitment of the tights onto the forms, with no recourse to collapsible forms or other complex, high-cost solutions.

Moreover, the absence of sharp edges on the tubular forms and tensioning members prevents any damage to the yarn during fitment, folding and removal of the tights, so that the device is particularly suitable for tights made of fine yarn, e.g. elastomeric yarn such as Lycra or similar.

In actual use, the device according to the invention may be made of any materials and of any size and shape as required.

I claim:

1. A method of folding tights on a hose shaping machine comprising a carousel conveyor with a number of pairs of peripheral tubular forms for receiving respective tights; characterized in that it comprises the steps of fitting the tights onto respective forms set to a parted position wherein the forms substantially lie in the same vertical plane; rotating at least one of said forms so that the forms are brought together into a facing position in parallel planes; operating on the front of the body of the tights, in an intermediate plane between the forms, by means of a first tensioning member operating in time with said rotation of the forms into the facing position, to cause said body to slide in relation to the forms and to form a center fold in the body; and operating on the rear of the body, in said intermediate plane between the forms, by means of a second tensioning member to form an opposite center fold in the body.

2. A device for folding tights on a hose shaping machine comprising a carousel conveyor with a number of pairs of peripheral tubular forms for receiving respective tights; said forms being movable in relation to each other between a parted position in which the forms substantially lie in the same vertical plane at a station at which the tights are fitted onto the forms, and a facing position in which the forms lie in parallel planes for shaping and removing the tights; characterized in that it comprises a first tensioning member fitted to a first of said forms and for operating on the front of the body of the tights, in an intermediate plane between the forms, as the forms are rotated into said facing position; and a second tensioning member fitted to a second of said forms and for operating on the rear of the body of the tights, in said intermediate plane between the forms, as the forms are rotated into said facing position.

3. A device as claimed in claim 2, characterized in that said first tensioning member is fitted for rotation to said first form fixed in a vertical plane substantially tangential to the conveyor, and is connected to said second form fitted to the conveyor so as to rotate about a vertical axis, so as to operate in time with the rotation of the second form into said facing position.

4. A device as claimed in claim 3, characterized in that said first tensioning member is connected to said second form by gear means connected to a pin for rotating the second form.

5. A device as claimed in claim 2, characterized in that said first tensioning member comprises a vertical rod fitted adjustably at the bottom to an arm extending horizontally from a sleeve rotating on the bottom portion of said first form fixed in a vertical plane substantially tangential to the conveyor; said sleeve forming a sprocket connecting said second form fitted to the conveyor so as to rotate about a vertical axis.

6. A device as claimed in claim 2, characterized in that said second tensioning member comprises a vertical rod fitted adjustably at the bottom to an arm extending horizontally from a sleeve rotating freely on a pin for rotating said second form fitted to the conveyor so as to rotate about a vertical axis.

7. A device as claimed in claim 2, characterized in that, at the bottom, said second tensioning member presents an integral tooth which, during the return travel into the parted position of said forms, engages a corresponding seat formed in said second form fitted to the conveyor so as to rotate about a vertical axis.

8. A device as claimed in claim 7, characterized in that said return travel of said second tensioning member is defined by a screw member fitted to a fixed first form and acting as a stop for the second tensioning member.

9. A device as claimed in claim 2, wherein:

a) each of said forms comprises a foot-shaped portion having a heel;

b) each of said forms includes a longitudinal axis; and c) each said foot-shaped portion is disposed at a predetermined angle relative to said longitudinal axis.

10. A device as claimed in claim 9, wherein:

a) said foot-shaped portions converge toward each other in said parted position.

* * * * *